US007990138B2

(12) United States Patent
Martin et al.

(10) Patent No.: US 7,990,138 B2
(45) Date of Patent: Aug. 2, 2011

(54) PROBE FOR ANALYSIS OF A STRING OF RODS OR TUBES IN A WELL

(76) Inventors: Jean-Pierre Martin, Garches (FR); Phillippe Broun, Sain-Egreve (FR); Jean-Paul Bongiraud, Varces Allieres et Risset (FR); Vincent Bongiraud, legal representative, Le Villard (FR); Jean-Louis Coulomb, Saint-Ismier (FR)

( * ) Notice: Subject to any disclaimer, the term of this patent is extended or adjusted under 35 U.S.C. 154(b) by 0 days.

(21) Appl. No.: 12/551,061

(22) Filed: Aug. 31, 2009

(65) Prior Publication Data

US 2010/0045278 A1 Feb. 25, 2010

Related U.S. Application Data

(63) Continuation of application No. PCT/FR2008/050462, filed on Mar. 18, 2008.

(30) Foreign Application Priority Data

Mar. 20, 2007 (FR) ..... 07 53921

(51) Int. Cl.
*G01N 27/82* (2006.01)

(52) U.S. Cl. ..... 324/221
(58) Field of Classification Search ..... 324/220–221
See application file for complete search history.

(56) References Cited

U.S. PATENT DOCUMENTS

| | | | | | |
|---|---|---|---|---|---|
| 2,558,427 | A * | 6/1951 | Fagan | 73/152.54 |
| 2,770,773 | A * | 11/1956 | Cooley | 324/221 |
| 2,892,151 | A * | 6/1959 | Bender | 324/221 |
| 2,897,438 | A * | 7/1959 | Fearon | 324/221 |
| 2,964,699 | A * | 12/1960 | Perriam et al. | 324/260 |
| 3,449,662 | A * | 6/1969 | Wood | 324/220 |
| 3,535,624 | A * | 10/1970 | Wood | 324/226 |
| 3,845,381 | A * | 10/1974 | Hart | 324/221 |
| 4,310,796 | A * | 1/1982 | Braithwaite et al. | 324/220 |
| 4,766,764 | A * | 8/1988 | Trevillion | 73/152.56 |
| 4,789,827 | A * | 12/1988 | Bergander | 324/220 |
| 4,808,925 | A * | 2/1989 | Baird | 324/221 |
| 5,293,117 | A * | 3/1994 | Hwang | 324/220 |
| 6,198,277 | B1 * | 3/2001 | Porter et al. | 324/220 |
| 7,038,444 | B2 * | 5/2006 | Crouch et al. | 324/220 |
| 7,403,000 | B2 * | 7/2008 | Barolak et al. | 324/221 |

FOREIGN PATENT DOCUMENTS

| | | | |
|---|---|---|---|
| JP | 55101044 | A * | 8/1980 |
| JP | 02218953 | A * | 8/1990 |
| WO | WO 8401627 | A1 * | 4/1984 |

* cited by examiner

*Primary Examiner* — Jay M Patidar
(74) *Attorney, Agent, or Firm* — Schwegman, Lundberg & Woessner, P.A.

(57) ABSTRACT

The invention concerns a probe for analysis of a collection of rods or tubes comprising an elongated casing which bears, at a first end, at least one first magnetometer and, at a position sufficiently remote from the magnetometer, a permanent magnet, the north-south axis of which is perpendicular to the axis of the rods.

16 Claims, 1 Drawing Sheet

PROBE FOR ANALYSIS OF A STRING OF RODS OR TUBES IN A WELL

RELATED APPLICATION

This application is a continuation under 35 U.S.C. 111(a) of International Application No. PCT/FR2008/050462, filed Mar. 18, 2008, and published as WO 2008/139070 A1, on Nov. 20, 2008, which claimed priority under 35 U.S.C. 119 to French Patent Application Serial No. 0753921, filed Mar. 20, 2007, which application and publication are incorporated herein by reference and made a part hereof.

FIELD OF THE INVENTION

The present invention concerns devices and processes for analysis of the state of hollow drilling rods (referred to hereinafter simply as 'rods') and of working tubes or pipe casings that are used, in particular, in the field of oil prospecting and oil mining.

Whilst a drill string is being inserted into the ground, or even once this string of drilling rods or a working pipe casing has been installed, it is sought to carry out various measurements on this drill string or this pipe casing. For example, it is sought to obtain knowledge as to whether a rod is stuck by virtue of a cave-in at depth, this cave-in being perhaps several thousand meters from the point of origin of the drilling. It may also be sought to detect the position of the joints of the drill string or of the pipe casing. In fact, a string of drilling rods or a working pipe casing is constituted by a collection of rods or tubes—having, for example, lengths of the order of around ten meters—, which are screwed onto one another, and the counting of the joints constitutes a fixing of position. It may also be sought to fix the locations of perforations or of zones of weakening, in particular through corrosion, of the pipe casings. It may also be sought to know about the stress condition at a point in a drill string whilst it is being raised from the point of origin, for example in order to create a neutral point at a given depth.

ACCOUNT OF THE PRIOR ART

In order to carry out these various measurements, at the present time use is made, in particular, of probes that analyse magnetic effects induced in the rods. These probes comprise means for measuring the magnetic field, possibly connected to means for creating a magnetic field.

The means for measuring the magnetic field are generally means for measuring the magnetic flux, which only operate if the probe is in a state of displacement, the amplitude of the signals received depending strictly on the speed of displacement.

The means for creating a magnetic field in a rod or tube (which is generally made of a ferromagnetic material or another material that is capable of acquiring a remanent magnetisation under the influence of the field) are generally means for generating an alternating field or a pulsed field. In particular, it has been proposed to use coils or rotary magnets as field-creating means. These means are used either in order to obtain a periodic remanent magnetisation in the rod or tube or, more generally, in order to create local zones of magnetisation by applying pulses to a coil periodically while it is being displaced in the drill string or in the pipe casing.

All the means utilised at present are relatively complex and costly, in particular on account of the fact that when it is desired to excite a coil at a great depth in the interior of a drill string it is necessary to energise this coil by means of a relatively substantial current through conductors of great length, and that, moreover, the bottom of a well may be at an elevated temperature, capable of attaining values higher than 175° C., which considerably limits the energy that can be dissipated in the coil.

Another difficulty is that the analysis probe that is sent into a drill string is generally associated with other elements, including, in particular, explosives intended to aid the unscrewing of a joint of rods at a chosen place, or to perforate a pipe casing for the purpose of subsequently bringing a well into production. The detonators associated with these explosives are capable of being affected by interference resulting from the application of intense current pulses in their immediate vicinity. It is then necessary to provide efficient shields, increasing the cost of the device and complicating its realisation.

SUMMARY OF THE INVENTION

Thus an object of the present invention is to provide a particularly simple probe for analysis of a collection of drilling rods or of working tubes or pipe casings.

Another object of the present invention is to provide several possible applications—which may be concomitant—of this probe, in particular in order to:

- detect the location of a sticking-point of rods,
- detect the positions of joints of rods or tubes,
- detect the positions of perforations and/or of zones of weakening, for example through corrosion, of a tube,
- detect a neutral point as far as the stress applied to a drill string is concerned.

In order to attain all or some of these objects, as well as others, the invention provides a probe for analysis of a collection of rods or tubes, said probe comprising an elongated casing which bears, at a first end, at least one first magnetometer and, at a position sufficiently remote from the magnetometer, a permanent magnet, the north-south axis of which is perpendicular to the axis of the rods.

According to one embodiment of the present invention, the probe comprises at least one second magnetometer arranged on the other side of the permanent magnet in relation to the first magnetometer.

According to one embodiment of the present invention, the magnet is constituted by a collection of magnets.

According to one embodiment of the present invention, the magnetometer is a magnetometer with magnetoresistors.

According to one embodiment of the present invention, four magnetometers are distributed on the periphery of the casing.

According to one embodiment of the present invention, the magnetometer or magnetometers is/are selected and disposed in order to be sensitive to a field in a transverse plane and insensitive to the axial components of the field.

One embodiment of the present invention consists in a process of analysis of a sticking-zone using the aforementioned probe, in accordance with which the probe is lowered and it is hoisted after having applied a stress, maintained or released, to the string of rods which is made of a magnetostrictive material.

One embodiment of the present invention consists in a process of analysis of a sticking-zone using the aforementioned probe, comprising the step of reading variations of magnetisation intensity in order to detect a relative variation of thickness or volume of material, resulting, for example, from joints of rods or of pipe casings, from pipe-casing perforations, from centering tools or other accessories, from anomalies and from pipe-casing deterioration, in particular through the effect of corrosion.

One embodiment of the present invention consists in a process of analysis of a sticking-zone using the aforementioned probe for the determination of a neutral traction zone, consisting in magnetising a chosen zone of a string of rods and in raising the string of rods while the variations of magnetisation in said zone are detected.

BRIEF DESCRIPTION OF THE DRAWINGS

These objects, characteristics and advantages, as well as others, will be set forth in detail in the following description of particular embodiments, which has been drawn up by way of non-limiting example in connection with the attached Figures, in which.

DETAILED DESCRIPTION

Figure 1:
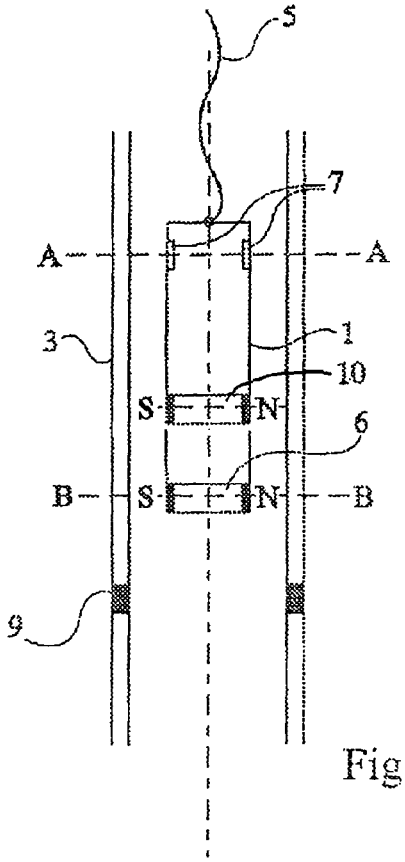
FIG. 1 represents, in schematic manner, a rod or a tube in which a probe according to one embodiment of the present invention is arranged.

As FIG. 1 illustrates, a probe casing 1 is dimensioned so as to be capable of being displaced in the interior of a string of rods or tubes 3 by being tied to a cable 5 for traction and for transmission of electrical signals.

As explained previously, the probe casing 1 usually comprises various elements other than the analysis elements which will be described below, for example specific drive means, means for spacing the walls of the rods or tubes, means for triggering an explosion, means for processing and for transmission of signals, etc.

The magnetic analysis-probe casing 1 bears a magnet 6, the north-south axis of which is orthogonal to the axis of the rods 3. An optional additional magnet 10 is also depicted. This casing also bears one or more devices 7 for measuring a magnetic field, for example magnetometers. It will be emphasised that it is indeed a question of magnetometers—that is to say, of elements that are capable of measuring the field created by a remanent magnetisation, independently of any movement of the probe, for example Hall-effect sensors or magnetoresistance sensors. These must be distinguished from the usual means for measuring flux, comprising a coil, which can only detect variations of magnetisation and which therefore only function when they are in a state of displacement in relation to a non-constant field. It is, of course, necessary to provide a configuration such that the direct influence of the magnet on the magnetometers is negligible. By way of example, the axial distance between the magnet and each set of magnetometers may be of the order of 30 cm to 2 meters, preferably from 50 cm to 1 meter, and more preferably of the order of 50 cm.

Figure 2:
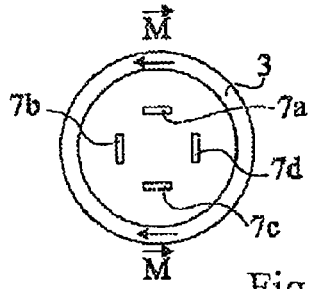
FIG. 2 is a view along sectional plane A-A in FIG. 1.
Figure 3:
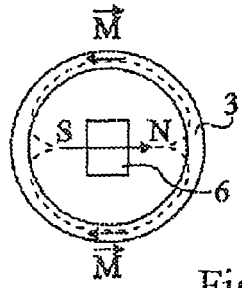
FIG. 3 is a view along sectional plane B-B in FIG. 1.

FIG. 2 is a sectional view according to plane A-A in FIG. 1, and FIG. 3 is a sectional view according to plane B-B in FIG. 1.

As FIG. 3 shows, the north-south axis of the magnet is in a plane that is perpendicular to the axis of the rods—that is to say that, as shown, this magnet will tend to create two magnetised zones in the form of half-rings in the rod, and the magnetisation vectors M in the rod will be essentially situated in a plane that is perpendicular to the axis of the rod.

Each of the magnetometers will be able to measure from 1 to 3 components of the field. Use will preferably be made of one or two of the components of the magnetometers sensitive to a field, said components being situated in a plane that is perpendicular to the axis of the probe. Since the magnetometers are sensitive to a field in a transverse plane and insensitive to the axial components of the field, the influence of the parasitic or stray magnetisations due to external sources (the earth's field, for example), essentially oriented axially, is rendered negligible.

If use is made, for example, of four magnetometers 7*a*, 7*b* 7*c* and 7*d* with the particular relative orientation between magnet and magnetometers represented in FIG. 2, the tangential component of the detected field will be maximal on the two magnetometers 7*a* and 7*c* only and minimal on the two other perpendicular magnetometers.

If a rotation of the probe by 90° occurs, the situation will be inversed, with the maximum of the signal on magnetometers 7*b* and 7*d*. For intermediate positions, it can be estimated that the sum of the signals will also give a signal of the same order of magnitude. Identical reasoning may be applied in respect of the radial components (at a rotation close to 90°). These components may be used separately or in combination. For this reason, and if there are at least four magnetometers arranged at 90° on the periphery, the relative angular position between the probe and the tube is of little importance.

The probe according to the present invention may be used in various ways, according to what it is desired to measure.

In order to detect the location of a jamming of a rod, one begins, for example, by lowering the probe in order to magnetise the walls of all the rods continuously, and, before bringing the probe back up, a stress (torsion, traction, compression, or combination of these stresses) will be applied to the drill string. This stress will be capable of being maintained or released before the probe is brought back up. If the rods are made of a magnetostrictive material, the parts having been subjected to the stress will have their magnetisation diminish appreciably, whereas the parts situated below the block will not be affected. In this way, upon being brought back up the zone in which the magnetisation will have varied (will have passed from a positive or negative value to an approximately zero value) will correspond to the zone situated above the sticking-point. It will be noted that this system, which operates continuously, is particularly sensitive and will, in particular, enable a progressive jamming to be detected.

The probe may be used for a counting of joints. During descent, just as when being hoisted, the magnetometers 7 will detect a variation in magnetisation when passing each of the joints of rods or tubes 9, which are present every 10 meters, more or less, in strings of drilling tubes or in conventional pipe casings. In fact, the remanent magnetisation is different in the region of the joints, since it is a function of the volume of material and of the thickness/diameter ratio.

Figure 4:
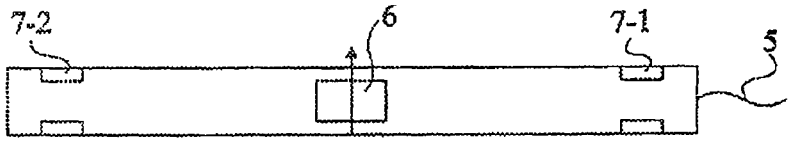
FIG. 4 represents, in schematic manner, an embodiment variant of a probe according to the present invention.

In order to count the joints better on coming back up, it will be possible, for example, to utilise a probe variant such as that represented in FIG. 4, comprising a central magnet 6 and two sets of magnetometers 7.1 and 7.2 arranged substantially symmetrically in relation to the central magnet 6.

In this way, the invention provides a particularly simple means for counting the joints, enabling the positioning of the probe in the drill string or pipe casing to be determined with more precision than by basing the position solely on the state of winding of the cable for supporting the probe. It is also possible to detect variations in thickness of the rods, which are associated, for example, with deformations, damage, corrosion or perforations.

Another application of the present invention consists in assisting the unscrewing of a string of drilling rods. In fact, after a jamming of rods, for example, the customary manoeuvre is to screw the rods right home, then to raise the drill string in such a way as to arrive at traction forces and weight forces that are substantially balanced in the region of the joint that it is desired to unscrew and that will then be unscrewed preferentially in relation to the other joints under stress. The probe according to the invention enables the determination of good traction on the rods to be assisted. In fact, once the joint of rods immediately above the sticking-zone has been determined, the probe is displaced around this sticking-point, in order to magnetise the rod, then one of the sets of magnetometers is arranged just above the joint that it is desired to unscrew. Afterwards, a progressive pull is exerted on the rods from the surface, and at the moment when the magnetisation measured in the region of the magnetometers attains a value determined by a prior calibration it is then known that the forces have been suitably balanced. It will be noted that if too strong a pull has been exerted, a magnetisation of the rods in the zone being considered can be undertaken anew, and a new measurement of decline in the value of magnetisation, associated with the magnetostrictive phenomenon, can be undertaken.

Figure 5:
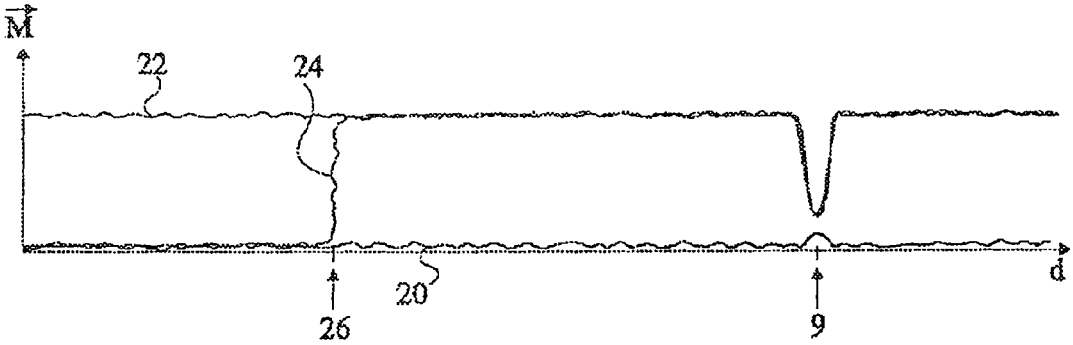
FIG. 5 represents readings taken with a probe according to one embodiment of the present invention.

FIG. 5 represents examples of magnetisation curves M as a function of the depth d.

Curve 20 represents the magnetisation observed in the absence of any polarisation, for example the magnetisation observed on the descent by the probe 7.2, placed lowest, of the embodiment shown in FIG. 4. Quite a weak background noise is observed, corresponding to the remanent magnetisation acquired in the earth's magnetic field.

Curve 22 represents the magnetisation resulting from the passage of the magnet 6, for example the magnetisation observed on the descent by probe 7.1 which follows the magnet 6. This is also what probe 7.1 or probe 7.2 would indicate on being hoisted. It will be noted that in the region of the joint of rods 9 a variation in magnetisation is observed. It will also be noted that with the magnets that are standard at the present time the signal contrasts very clearly with the background noise associated with the earth's magnetic field, in practice in a ratio that may be as high as 50.

Curve 24 represents the signal observed upon hoisting the probe when there is jamming at a point 26 and when a stress has been applied to the rods from the surface, having the result that, as a consequence of the magnetostriction, the magnetisation is substantially erased where the stress has been applied, enabling a point 26 to be positioned, in the region of which the jamming of a rod has taken place. It is following this that the operations of disassembly noted previously will be able to be carried out.

The present invention presents numerous advantages which will be apparent to a person skilled in the art. In particular, on account of the fact that the field created by the magnet 6 is situated in a plane transverse to the axis of the rods the induced magnetisation is much more concentrated than if the magnet were parallel to the axis of the rods, in which case the field lines would be distributed over a larger zone. This helps to achieve a better focused and more intense signal.

It will also be noted that the present invention constitutes a particularly simple means for locating joints and therefore for making measurements of depth in a drilling well or operating well. This is made possible on account of the fact that use is made of a signal that is independent of the speed of displacement, and not of an alternating signal or pulsed signal.

One advantage of the present invention is that it enables measurements of location of joints and of determination of a blocking-point in the course of one and the same pass, even in the presence of rotations due to a twisting of cable.

The magnets will be, for example, samarium-cobalt magnets or neodymium-iron-boron magnets that are capable of creating a magnetic induction of the order of one tesla. It will also be possible to use several magnets, if this is desired.

In addition, it will be noted that, in view of the intensity of the fields provided by modern magnets, use may be made of one and the same probe for the purpose of entering rods having quite different diameters, for example drilling rods with a diameter of 8.75 cm to 12.5 cm (3.5 inches to 5 inches), working pipe casings which are accessed through a tube for bringing up hydrocarbon, the pipe casing having, for example, a diameter of 17.5 cm (7 inches), whereas the tube for bringing up hydrocarbon only has a diameter of 5 cm to 6.1 cm (2 inches to 2⅜ inches). The system then has to be particularly sensitive.

In fact, if use is always made of a magnet adapted to a tube of 6 cm, it has been established that the ratio of the magnetisation created by this magnet to the parasitic magnetisations is greater than 50. If one passes from a tube of 6 cm to a tube of 17.5 cm, the field may be divided by about 25, but even so it remains very large in comparison with the earth's field, preserving a sufficient sensitivity for the system.

These particular advantages of the present invention result from the simple association of a fixed permanent magnet of high power with a detector of the magnetometer type. The use, with a fixed magnet, of sensors for measuring the variation of flux, and not of magnetisation sensors, would not provide the same results, since it would then be possible to carry out the measurements only during a displacement of the probe. Likewise, the specific orientation of the magnetisation magnet—perpendicular to the axis of the rod—provides a clear increase in sensitivity. Tests have shown that the gain obtained is greater than 20 in comparison with the arrangement of the magnet along the longitudinal axis of the rods or of the pipe casing.

The invention claimed is:

1. A probe for analysis of a string of drilling rods or pipe casing having a circumference, comprising, an elongated probe casing comprising, at a first end, at least one first magnetometer and, at a position remote from the magnetometer, a permanent magnet, the north-south axis of which is perpendicular to the longitudinal axis of the drilling rods or pipe casing, the permanent magnet in fixed relation to the probe casing and disposed in a transverse plane to induce a magnetic field in the plane from the north axis to the south axis along a portion of the circumference, wherein the first magnetometer is to detect magnetisation of the drilling rods or pipe casing independently of movement of the permanent magnet.

2. The probe according to claim 1, comprising a second magnetometer arranged on the other side of the permanent magnet relative to the first magnetometer.

3. The probe according to claim 1, in which said permanent magnet comprises multiple permanent magnets.

4. The probe according to claim 1, in which said magnetometer comprises a magnetoresistance sensor.

5. The probe according to claim 1, wherein the at least one magnetometer comprises four magnetometers distributed on a periphery of the casing.

6. The probe according to claim 1, in which said at least one magnetometer is selected and disposed in order to be sensitive to the field in the transverse plane and insensitive to axial components of the field.

7. A process of analysis of a sticking-zone of a string of drilling rods having a circumference, comprising:

using a probe comprising an elongated casing including, at a first end, at least one first magnetometer and, at a position remote from the magnetometer, a permanent magnet, the north-south axis of which is perpendicular to the axis of the rods, the permanent magnet in fixed relation to the probe casing and disposed in a transverse plane to induce a magnetic field in the plane from the north axis to the south axis along a portion of the circumference, wherein the at least one first magnetometer is to detect magnetisation of the drilling rods independently of movement of the permanent magnet;

lowering the probe through the string of drilling rods made of a magnetostrictive material;

applying a stress to the string of drilling rods; and hoisting the probe through the string of drilling rods.

8. The process of analysis of a sticking zone of claim 7, further comprising relieving the stress applied to the string of rods.

9. A process of analysis, comprising:

using a probe comprising an elongated casing including, at a first end, at least one first magnetometer and, at a position remote from the magnetometer, a permanent magnet, the north-south axis of which is perpendicular to the axis of a string of drill rods or pipe casings having a circumference, the permanent magnet in fixed relation to the probe casing and disposed in a transverse plane to induce a magnetic field in the plane from the north axis to the south axis along a portion of the circumference, wherein the at least one first magnetometer to detect magnetisation of the string of drill rods or pipe casings independently of movement of the permanent magnet;

moving the probe through the string of drill rods or pipe casings; and reading variations of magnetisation intensity in order to detect a variation relating to thickness or volume of material in the string of drill rods or pipe casings.

10. The process of analysis of claim 9, wherein the variation relating to thickness or volume of material results from at least one of pipe-casing perforations, centering tools, anomalies and pipe-casing deterioration through the effect of corrosion.

11. A process of analysis, comprising:

using a probe comprising an elongated casing, the probe including, at a first end, at least one first magnetometer, and at a position remote from the magnetometer, a permanent magnet, the north-south axis of which is perpendicular to the longitudinal axis of drilling rods or the pipe casings, the permanent magnet in fixed relation to the probe casing;

moving the probe through a chosen zone of a string of drilling rods or pipe casings to magnetize the chosen zone;

raising the string of rods while the variations of magnetisation in said zone are detected; and determining a neutral traction zone in the string of drilling rods or pipe casing.

12. A probe for analysis of a drill string or pipe casing having a circumference, comprising, a probe casing, a first magnetometer supported by the probe casing, and a permanent magnet supported by the probe casing in spaced relation to the first magnetometer, the permanent magnet having the north-south axis extending perpendicular to the axis of the elongated casing, the permanent magnet in fixed relation to the probe casing and disposed in a transverse plane to induce a magnetic field in the plane from the north axis to the south axis along a portion of the circumference, wherein the first magnetometer is to detect magnetisation of the drill string or pipe casing independently of movement of the permanent magnet.

13. The probe of claim 12, further comprising at least a second magnetometer.

14. The probe of claim 13, wherein the first and second magnetometers are each capable of measuring a field created by remanent magnetisation.

15. The probe of claim 12, wherein at least one of the magnetometers comprises a Hall-effect sensor.

16. The probe of claim 12, wherein at least one of the magnetometers comprises a magnetoresistance sensor.

* * * * *

UNITED STATES PATENT AND TRADEMARK OFFICE

CERTIFICATE OF CORRECTION

PATENT NO. : 7,990,138 B2
APPLICATION NO. : 12/551061
DATED : August 2, 2011
INVENTOR(S) : Jean-Pierre Martin et al.

It is certified that error appears in the above-identified patent and that said Letters Patent is hereby corrected as shown below:

On the Title page, in field (75), in "Inventors", in column 1, line 2, delete "Sain-Egreve" and insert -- Saint-Egreve --, therefor.

In column 7, line 35, in Claim 9, delete "to" and insert -- is to --, therefor.

In column 8, line 9, in Claim 11, delete "or the" and insert -- or --, therefor.

In column 8, line 12, in Claim 11, delete "of" and insert -- of the --, therefor.

In column 8, line 13, in Claim 11, delete "or" and insert -- or the --, therefor.

In column 8, line 15, in Claim 11, delete "of" and insert -- of the drilling --, therefor.

In column 8, line 17, in Claim 11, delete "of" and insert -- of the --, therefor.

In column 8, line 18, in Claim 11, delete "or" and insert -- or the --, therefor.

in column 8, line 18, in Claim 11, delete "casing." and insert -- casings. --, therefor.

Signed and Sealed this
Eleventh Day of October, 2011

David J. Kappos

David J. Kappos
*Director of the United States Patent and Trademark Office*